United States Patent [19]

Botkins

[11] 4,048,727

[45] Sept. 20, 1977

[54] RECIRCULATING GRAIN DRYER

[75] Inventor: Walter Y. Botkins, Leawood, Kans.

[73] Assignee: Berico Industries, Inc., Shawnee Mission, Kans.

[21] Appl. No.: 677,053

[22] Filed: Apr. 14, 1976

[51] Int. Cl.[2] ..... F26B 7/00

[52] U.S. Cl. ..... 34/13; 34/65; 34/169

[58] Field of Search ..... 34/167, 168, 169, 174, 34/82, 13, 33, 64, 66, 65; 432/96, 101

[56] References Cited

U.S. PATENT DOCUMENTS

| | | | |
|---|---|---|---|
| 707,323 | 8/1902 | Hess, Jr. | 34/169 |
| 1,210,166 | 12/1916 | Hess | 34/169 |
| 1,711,574 | 5/1929 | Miller | 34/46 |
| 3,053,522 | 9/1962 | Applegate | 34/174 |
| 3,092,472 | 6/1963 | Figley | 34/174 |
| 3,440,734 | 4/1969 | Batterton et al. | 34/174 |
| 3,629,954 | 12/1971 | Lavalier | 34/174 |
| 3,751,824 | 8/1973 | Kyle | 34/174 |

*Primary Examiner*—John J. Camby
*Assistant Examiner*—Larry I. Schwartz
*Attorney, Agent, or Firm*—Fishburn, Gold & Litman

[57] ABSTRACT

Improved process and apparatus for drying are disclosed whereby a moist granular material is dried by contact with a heated gas and is then cooled by contact with a cooler gas. The cooling gas is supplied to the cooling zone at a pressure which exceeds atmospheric pressure. During passage through the cooling zone, the temperature of the cooling gas is increased, and all of it is then circulated to the heating zone in order to reuse the heat thus absorbed for drying still more granular material. Fuel utilization and drying cost can be substantially reduced, and the invention is especially suitable for use with recirculating grain dryers.

17 Claims, 4 Drawing Figures

RECIRCULATING GRAIN DRYER

BACKGROUND OF THE INVENTION

The present invention pertains to the drying of moisture-laden granular materials, such as grain for example, and more particularly pertains to the drying and then the cooling of such materials by direct contact with heating and cooling gases. In one specific respect, the invention pertains to improvements in recirculating grain dryers wherein grain is dried by contact with hot air and is then cooled by contact with cooler air.

Grain dryers of the aforementioned type wherein wet grain is dried and then cooled by means of hot and cold air are well known and widely used. Some of the representative types are disclosed, for instance, in U.S. Pat. Nos. 1,669,012; 3,313,040 and 3,629,954, and it should be pointed out that such dryers are dependent upon circulation of relatively large volumes of hot and cold air if thorough drying and cooling of the grain at a satisfactory rate is to be obtained. As a consequence, the thermal and electrical energy requirements for drying of grain can be substantial. In addition, there can be objections to such dryers when excessive amounts of chaff, husks, dust, etc., are discharged into the atmosphere along with the gases that are exhausted therefrom. Further objections have been raised when the dryer emits objectional noise or requires a pressurized enclosure.

It is therefore an object of the present invention to provide for the drying of granular materials in a manner whereby the energy requirements for drying are reduced.

Another object is to provide a dryer having improved means for cooling granular material following the drying thereof.

Yet another object is to provide for the drying of granular material in a manner whereby emission of objectionable substances into the atmosphere is alleviated.

Still another object is to provide a dryer for granular material whereby the emission of noise at objectionable levels is alleviated.

Even another object is to provide an improved grain dryer.

Another object is to reduce the cost of drying grain.

Other objects and advantages of the invention will become apparent from the following description and the appended claims.

SUMMARY OF THE INVENTION

An improvement is provided for dryers wherein granular material is dryed and cooled by contact in heating and cooling zones with heating and cooling gases, respectively. A cooling gas supply means is used whereby cooling gas is supplied to the cooling zone at a positive pressure that is greater than atmospheric pressure, and which will be referred to hereinafter merely as "positive pressure." In addition, recycle means is also used whereby all of the cooling gas is circulated to a heating gas supply means, thereby permitting reuse of heat absorbed by the cooling gases, following additional heating thereof, for drying more granular material in the heating zone.

To advantage, part of the heating gases leaving the heating zone can be blended with the warmed cooling gases and recycled to the heating zone for increased neutilization of heat during a continuous drying operation. The balance of the heating gases are discharged into the atmosphere along with moisture removed from the material being dryed. A preferred ratio of recycled to discharged gases is 2 to 1, respectively. Means can also be employed for turning the grain to assist drying and cooling, and recycled gases can be screened for removal and proper disposal of solid materials entrained therein.

DESCRIPTION OF PREFERRED AND ALTERNATIVE EMBODIMENTS

Figure 1:
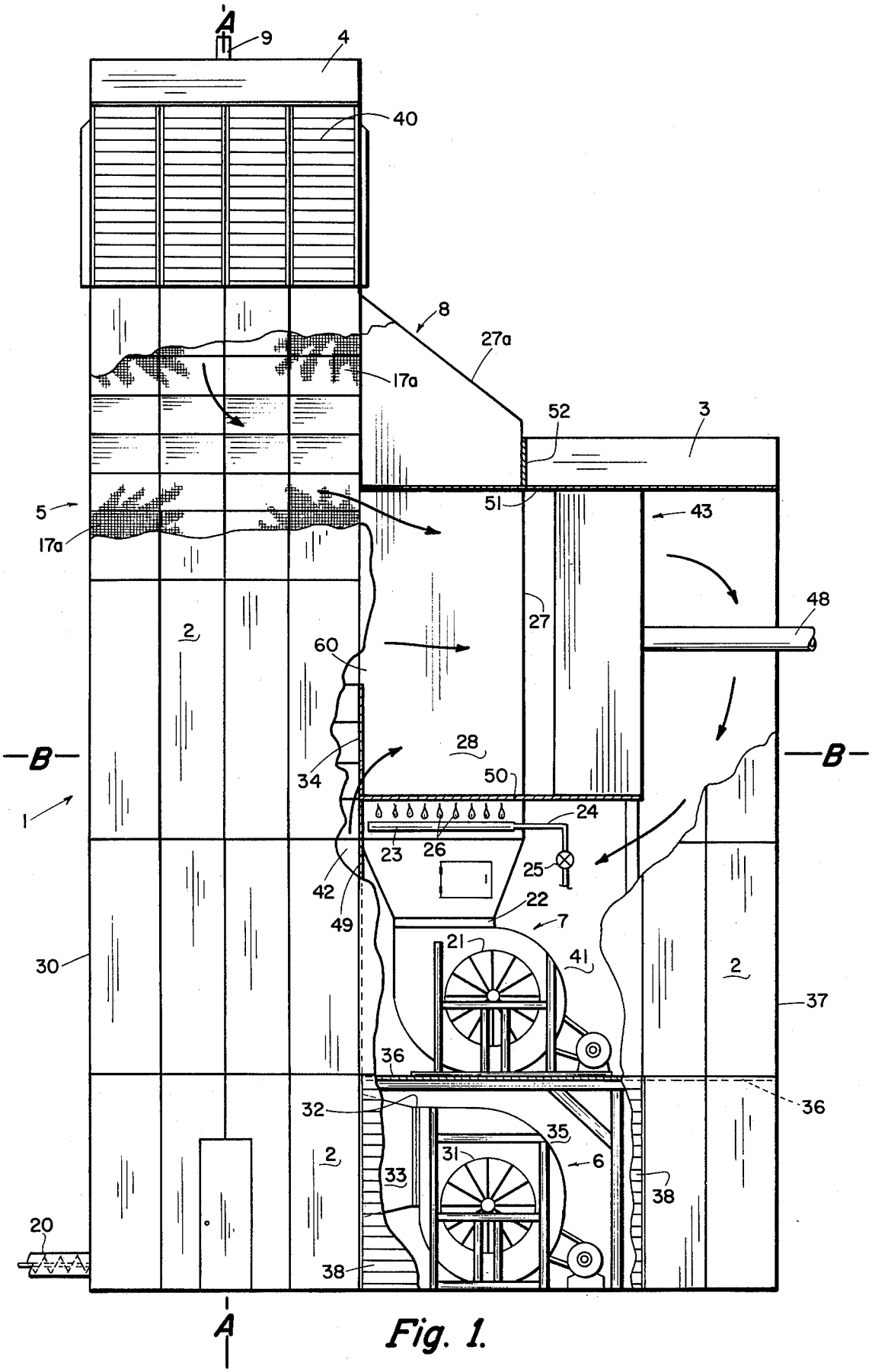
FIG. 1 is a side view, partially in section, of a grain dryer constructed in accordance with the present invention.
Figure 2:
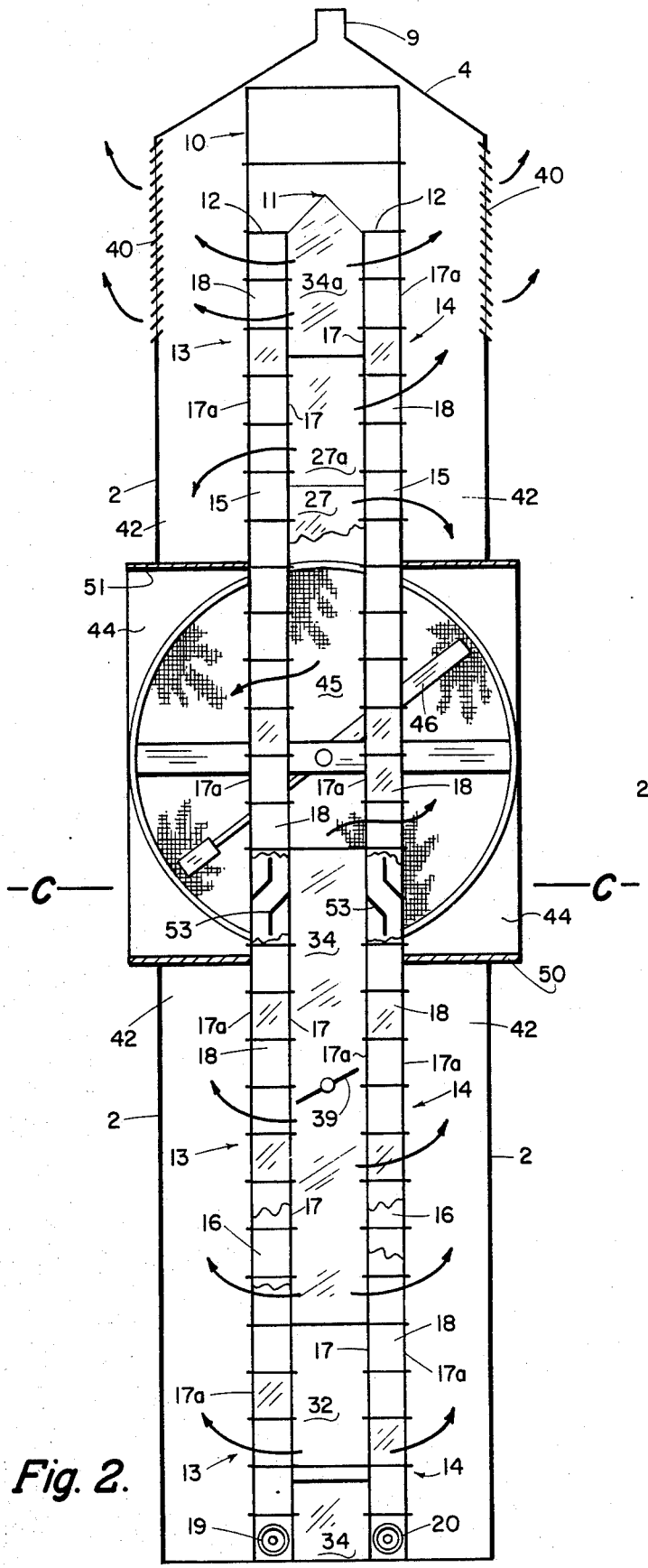
FIG. 2 is a front sectional view of the dryer taken along line A—A of FIG. 1.

In FIG. 1, a grain dryer is generally represented at 1, and has sheet metal sides 2, outer end walls 30 and 37, and roofs 3 and 4 which enclose drying columns represented at 5, first and second gas blowers represented at 6 and 7, respectively, and part of the hot air duct 8 that leads from the second blower 7 to the drying columns. Referring to FIG. 2, moist grain is fed into the dryer by means of a supply conduit 9 and falls into a bin 10 having an upwardly arched divider 11 at the bottom and which lies between upper inlets 12 in the first and second vertically elongated dryer columns 13 and 14. Each of the dryer columns comprises an upper heating zone 15 that interconnects with a lower cooling zone 16, both zones being bounded by inner and outer porous side walls 17 and **17*a* and impervious end walls 18. Augers 19 and 20 are located toward the lower end of each of the columns 13 and 14 for removal of dried and cooled grain therefrom. The drying process can thus be carried out at a substantially constant rate by continuously feeding moist grain into the dryer columns through supply conduit 9** while continuously removing dried and cooled grain from the bottom of the columns by means of the augers, with flow of the grain from the top to the bottom of the columns being effected by gravity.

Figure 3:
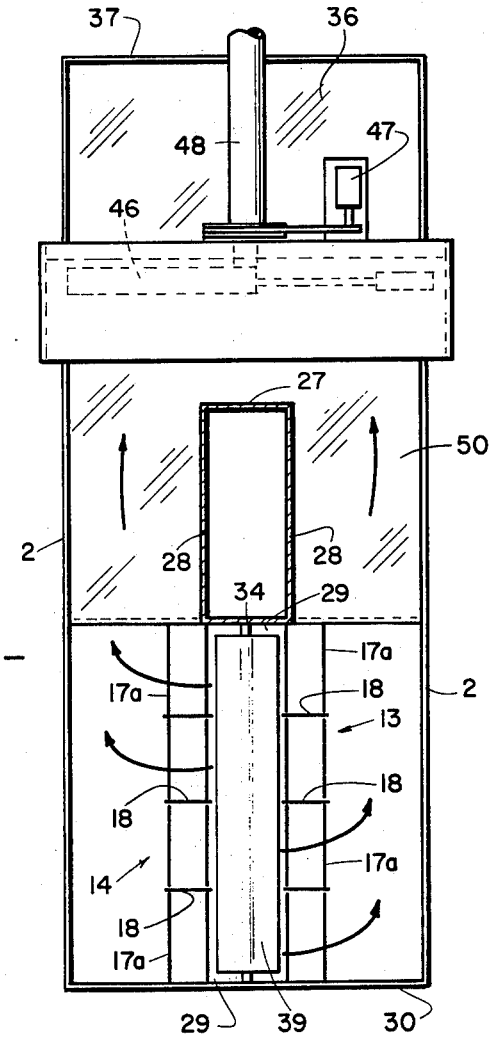
FIG. 3 is a top sectional view of the dryer taken along line B—B of FIG. 1.
Figure 4:
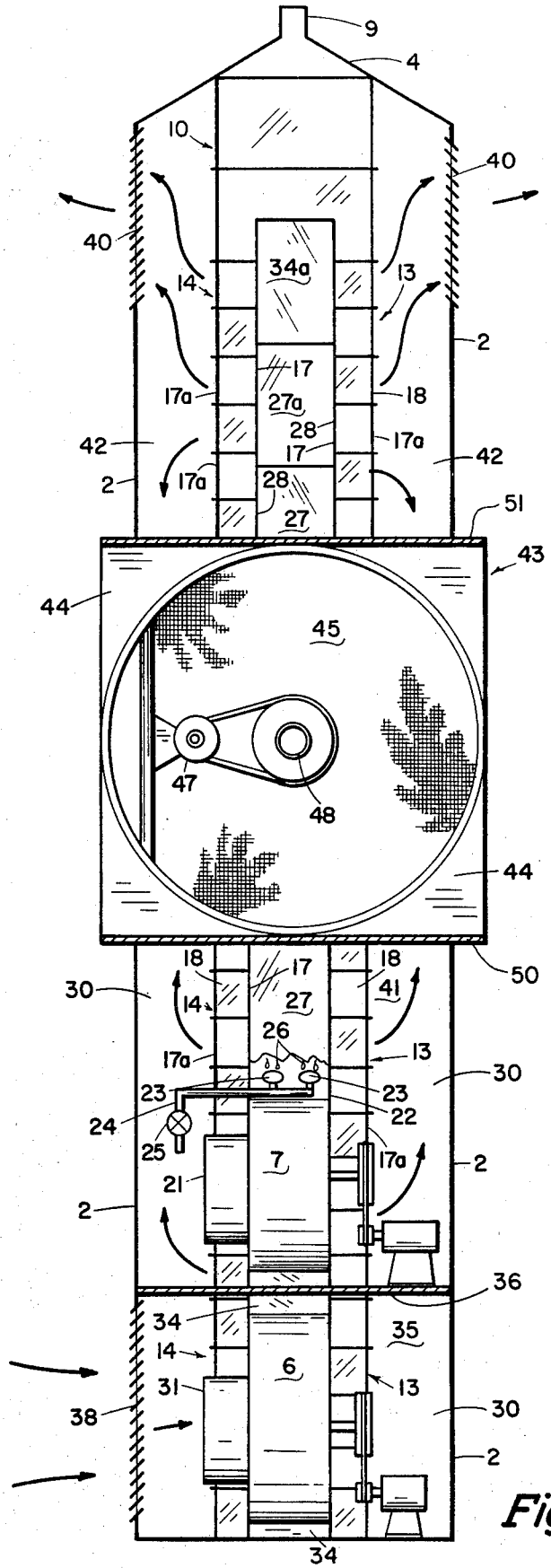
FIG. 4 is a rear sectional view of the dryer taken along line A—A of FIG. 1.

The heating zones 15 of the columns 13 and 14 reside above the line C—C in FIG. 2, whereas the cooling zones 16 reside below this line. Referring to FIGS. 1 and 3, air heated by mixture with hot combustion products is fed to and through the heating zones 15 by means of a heating gas supply means which comprises a gas blower 7 having an inlet 21 and an outlet 22, the latter of which leads into hot air duct 8, and also a burner 23 having a supply line 24 for fuel, such as natural gas and a valve 25 for controlling the rate at which the fuel is supplied to the burner. During operation, the burner 23 produces flames 26 by combustion of the fuel, and the resulting hot flame gases become mixed with other gases being propelled by the blower 7. The duct 8 has a rear wall 27, a top **27*a*, and side walls 28. The front of the duct 8 is open over most of its upward extension so that heating gas can circulate into the space 29 between dryer columns 13 and 14, then into and out of the columns, from inside to outside. Accordingly, the space between the columns 29 is sealed at the front end by means of outer end wall 30 of the dryer enclosure, and is partially closed at the rear end by cover plates 34 and 34***a*.

Gas for heating the grain is thus introduced into the space 29 through opening 60 which extends from the top of cover plate 34 to the bottom of cover plate 34*a*. Cooling gas for lowering the temperature of the grain after it leaves the heating zone is fed to and through the cooling zones 16 by means of a cooling gas supply means which comprises a gas blower 6 having an inlet 31, an outlet 32, and a short discharge duct 33 which leads through the lower cover plate 34 and into space 29, between columns 13 and 14. The blower 6 is housed in a lower room 35 of the enclosure and is separated from blower 7 by a ceiling 36 between side walls 2 and which extends from end wall 37 to columns 13 and 14. Air from the atmosphere outside of the enclosure is drawn into room 35 and thence into blower 6 through louvers 38 in one of the side walls 2, and is thus fed into space 29 by blower 6 at a positive pressure. As represented in the drawings, the dryer is not provided with a fixed partition across space 29 between the upper and lower portions thereof, but is equipped with a damper 39 for balancing pressure and gas flow within the space when introducing gases thereto by means of one or both of the blowers 6 and 7.

As was previously indicated, all of the cooling gas which is fed through the cooling zone is circulated to the heating gas supply means for mixture with heating gases supplied thereby to the heating zone. Accordingly, the heat absorbed from grain during the cooling thereof can be reused for the heating and drying of additional grain. The recycle means for accomplishing this reuse of heat can comprise barrier walls whereby cooling gas leaving the cooling zones 16 must travel to and through gas blower 7 and the heating zones 15 before it is eventually exhausted into the atmosphere. Louvers 40 located in walls 2 adjacent the upper ends of the heating zones are an enclosure venting means through which the gases can be discharged therefrom.

With further regard to the recycle means, blower 7 is enclosed within a room 41 that is separated from room 35 below it by means of the ceiling partition 36 and walls 2 and 37. Cooling air which discharges from the lower ends of columns 13 and 14 moves upwardly along the outsides thereof through spaces 42 and is drawn by blower 7 into the inlet 21 thereof. The air supplied to the cooling zones by blower 6 plus some air recirculated from the heating zones become the major portion of the gaseous feed to blower 7, since it is preferred that a portion of the heating gases be recycled to the blower 7 to further conserve and reuse heat. Another portion of the gaseous feed to heating gas supply blower 7 is combustion gases from flames 26, and moisture released from the grain as water vapor during the drying procedure. As was previously indicated, any portion of the heating gases that are not recycled back through blower 7 are vented to the atmosphere through louvers 40 in the top of the enclosure.

Although the inner and outer porous walls 17 and 17*a* of the columns 13 and 14 substantially retain the grain within the drying and cooling zones, some chaff and husks can pass through these walls and it is therefore preferred that such solid materials be screened out of the gases before they pass into the inlet 21 or blower 7. As shown in the drawings, a self-cleaning screen assembly for this purpose is generally represented at 43 and comprises an outer frame 44 having a circular cleaning screen 45 thereon and a vacuum-cleaning arm 46 that is rotated by means of a gearmotor 47. During operation, cooling and heating gases circulating toward blower 7 must pass through the screen 45 for removal of chaff and husks, and vacuum arm 46 is rotated by gearmotor 47 in order to remove such materials from the screen as they accumulate thereon, and they are thence conveyed through vacuum line 48 for collection in a bag filter, not shown. Circulation of cooling gases and recycled heating gases through screen 45 during transit to blower 7 can be assured by means of partition walls such as 49, 50, 51 and 52 which block off any pathways that the gases might take in avoiding the screen. The general path taken by the gases enroute to the screen and blower inlet 21 are represented by the arrows in FIGS. 1–4.

In FIG. 2, plates 53 are located within the heating zones 15 in order to divert the flow of grain, as it moves downwardly, from the inner porous wall to the outer porous wall of the columns 13 and 14. The flow of grain is thereby turned away from the hotter inner wall and diverted toward the cooler outer wall, thus preventing "hot sides" and consequential overheating of the grain. When such flow diverting means are used in conjunction with the present invention, they can be installed at one or more suitable locations along the length of the column, with installation about half way down the column being advantageous.

It will be appreciated that at least some portion of the gases introduced into the dryer enclosure must be exhausted therefrom during continuous drying of grain. While the proportion of recycled to exhausted heating gases is subject to variation, it has been found that a satisfactory ratio is about 2 to 1, i.e. about $\frac{2}{3}$ of the total gas volume discharged from the outer porous walls 17*a* of the columns is recycled through blower 7 while about $\frac{1}{3}$ is exhausted into the atmosphere along with expelled moisture, through louvers 40 of the enclosure. Paritions between the upper and lower portions of the spaces 42 are not essential in effecting the desired proportion of recycled to exhausted heating gases, since it has been determined that the desired proportioning of recycling to exhausting flow rates can be effected in their absence.

In accordance with the present invention, most of the moisture can be removed from the grain in the upper one-third of the columns 13 and 14 and can be expelled from the dryer as water vapor in mixture with the heating gases being exhausted therefrom. It is generally not preferable that this minor but heavily moisture-ladened portion of the heating gases be recycled as heating gas, and its loss from the system is replenished mainly by circulating air to blower 7 from the cooling zones after the air has absorbed heat from the grain. Heat lost into the atmosphere by radiation from the dryer enclosure, or through discharge of heating gases therefrom, is replenished by burning fuel at the burner 23. Where preferred, blowers 6 and 7 can be provided with dampers at the outlets, and thermostatic elements can be placed at various locations within the dryer, so that means are provided whereby gas flow rates and temperatures in various regions of the dryer can be controlled automatically and/or manually to provide safe and satisfactory drying of grain.

Even though the present invention has been described with reference to grain dryers having vertically elongated columns with porous walls wherein the grain is dried and cooled, it will nonetheless be understood that the invention is adaptable to the drying of granular materials other than grain. Where preferred, gases other than air can be used for heating and cooling the material being dried, with replenishment of heat being accomplished by means of indirect heat exchange or other suitable methods. It will further be appreciated that it is not essential that the cooling and heating zones be vertically disposed or that these zones be portions of the same confined space, e.g. the heating zone can be confined by one or more wall whereas the cooling zone can be confined by one or more other walls. It is preferred that both the heating and the cooling zones be bounded by porous walls through which the heating and cooling gases are passed for contact with the granular material being dried, that both zones be vertically elongated, and that the heating zone have feed means, such as inlet 9, for supplying moist granular material to the top of the zone, and that the cooling zone have discharge means such as augers 19 and 20, for removal of dried and cooled grain from the bottom of the zone.

Even though the heating and cooling zones can be arranged in a side-by-side relationship, it is preferred that the heating zone be located above the cooling zone and lead directly into the cooling zone. Accordingly, both zones can be bounded by first and second porous walls along their lengths, while using a cooling gas supply means that comprises a first gas blower having an inlet leading from the atmosphere and an outlet leading to the first of the porous walls in the proximity of the cooling zone for supplying cooling air thereto under positive pressure. In conjunction therewith, a recycle means can be used that comprises an enclosure into which the heating and cooling gases are discharged through the second of the porous walls, and a heating gas supply means can be used that has an inlet leading from the interior of the enclosure and an outlet leading to the first of the porous walls in the proximity of the heating zone.

Grain dryers built in accordance with the present invention can effect substantial savings in fuel costs when continuously drying grain at a preestablished rate since both the preheated air from the cooling zone and a large part of the air from the heating zone are recirculated to the heating zone, as previously described. Assuming that heating air leaves the heating zone at 120° F and 100% relative humidity, a 20 percent rise in the temperature of the air lowers the relative humidity thereof by roughly one-half and thus doubles its capacity for holding moisture. If the temperature of the air at 120° F and 100% relative humidity is raised to 200° F by means of the heater, the relative humidity is reduced to about one-sixteenth the level at 120° F, i.e. it is reduced to about 6.25%. Consequently, the moisture picked up by the air during its first pass through the dryer columns can be relatively insignificant thereby permitting recycling of the air through the heating zone a number of times, and it is for this reason that the volume of recycled air can be substantially higher than the volume that is exhausted into the atmosphere.

It should be pointed out that grain dryers constructed and operated in accordance with the present invention provide a significant advantage over prior dryers wherein the cooling air is merely drawn through the cooling zone by means of the hot air fan. Using apparatus presently disclosed, the cooling air can be pushed through the cooling zone by pressure in excess of atmospheric pressure. There is thus greater assurance of sufficient cooling, for if the motive power of the hot air fan must be relied upon to pull a stream of air through the cooling zone while also recycling a portion of the heating air back to the heating zone, regulation of one of these streams must be at the expense of the other, i.e. increasing the flow rate of the heating air stream will decrease the flow rate of the cooling air stream, and vice versa.

The ability to provide sufficient cooling air can be assured by use of a blower such as 6 which supplies cooling zones 16 at a pressure greater than atmospheric pressure, and by housing blower 6 and its inlet 31 in a room 35 having an inlet vent 38, and which also houses the lower end of the cooling zones. With this arrangement, the air flow from blower 6 can remain substantially constant even upon change of the ratio of heating air being recycled to blower 7 and being exhausted through louvered vent 40. Accordingly, the flow rate of air through the cooling zone can be much higher than when pulled in by means of the hot air fan, the amount of heat that can be removed from the grain during cooling is higher, and the recycle of heat to the heating zone is thus higher, thereby providing additional reductions in the utilization and cost of fuel.

Figure 5:
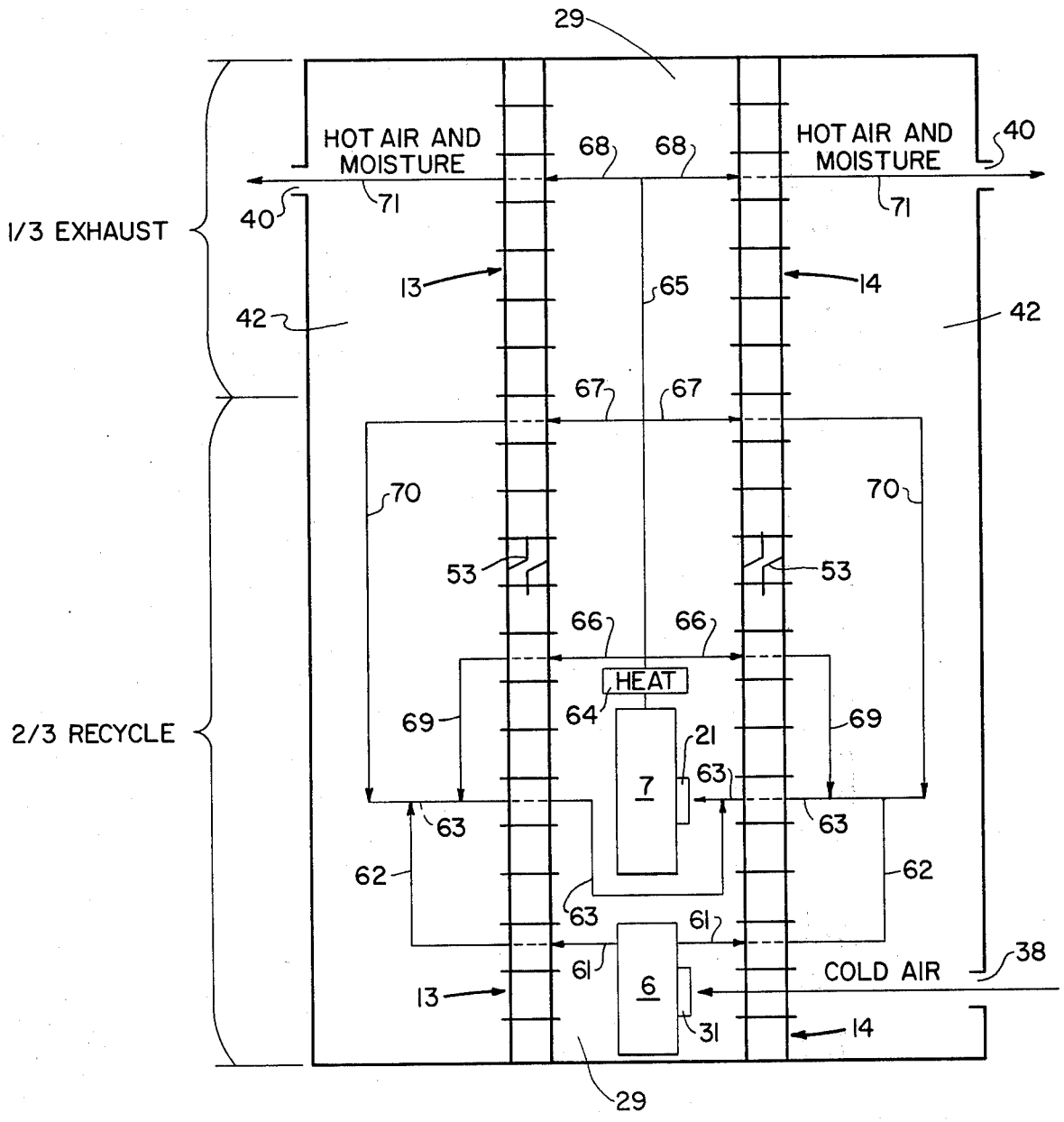
FIG. 5 is a schematic flow diagram showing the paths followed by heating and cooling gases in the dryer of FIGS. 1-4.

FIG. 5 is a schematic flow diagram which shows the paths taken by hot and cold air during use of the grain dryer of FIGS. 1–4. Ambient air is drawn into the enclosure through inlet vent 38 by cold air blower 6 and is fed through the lower ends of the columns 13 and 14 as represented by lines 61. After passing through the columns, the cold air is then drawn toward inlet 21 of the hot air blower 7, as indicated by lines 62 and 63. Heat is supplied at 64 to air leaving blower 7 via line 65, and heated air is thus supplied to the upper portion of columns 13 and 14 through lines 66, 67 and 68. Hot air being discharged from the middle portion of the columns is recycled back to the hot air blower, as represented by line 71. The flow paths taken by the gases is represented only schematically, i.e. some of the cold air can leave the columns at points higher and/or lower than shown, as can the hot air. In any case, all of the cold air is conveyed to the hot air fan after being discharged from the columns, and some portion of the heating gases is expelled from the enclosure through vent 40 along with moisture removed from the grain.

FIG. 5 represents a preferred embodiment wherein about $\frac{2}{3}$ of the gaseous discharge from the columns 13 and 14 is recycled to the hot air blower while the other $\frac{1}{3}$ is discharged into the atmosphere. It has been determined that the dryer can be self-balancing at these proportions, i.e. no partitioning of spaces 42 at the outside of the columns is needed to effect the desired recycle to exhaust proportion of 2/1. By omitting partitions in these spaces the system nonetheless remains in balance, thereby avoiding inefficiencies which tend to produce overheating and/or overdrying and/or excessive use of fuel as a result of improper pressure differentials. This provides an important advantage in that use of such partitions can also result in a need for slide gates which must be frequently adjusted in order to properly balance the amount of recycled to exhausted air. The situation can be even further complicated when cold air is drawn into the enclosure by means of a single fan for hot and cold air, since slide valve manipulation becomes even more frequent and critical.

Coupled with supply of the cold air under positive pressure and $\frac{2}{3}$ recycle as previously mentioned, turning of the grain by plates 53 about midway of the length of columns 13 and 14 is also preferred with these conditions since it has been found to benefit both drying and cooling of the grain.

Other advantages of grain dryers constructed in accordance with the present invention include reduced emission of dust and chaff into the atmosphere by virtue of reducing the air volume that must be exhausted into the air, and quietness of operation which results from placing the hot and cold gas blowers in separate enclosures. In addition, the dryer enclosure does not have to be stressed for pressurization since venting of both the heating and the cooling sections to the atmosphere effects only a light differential of inside and outside pressures.

Method and means for drying granular materials has now been described whereby the stated objects can be fulfilled by those skilled in the art, and even though the invention has been described with reference to particular materials to be dried, heating and cooling gases, apparatus, apparatus arrangements, methods of operation, proportions, and the like, it will nonetheless be understood that even other embodiments will become apparent which are within the spirit and scope of the invention defined in the following claims.

What is claimed and desired to secure by Letters Patent is:

1. A process for drying granular material comprising:

a. feeding a moisture-ladened material to a heating zone and drying same therein by contact with a heating gas that is passed through the heating zone and into a gas flow space open to the atmosphere, and passing a portion of said heating gas to the atmosphere from said gas flow space without passing through said heating zone, b. thereafter feeding the heated granular material into a cooling zone and cooling same therein by contact with a cooling gas that is passed through the cooling zone into said gas flow space, c. supplying said cooling gas to the cooling zone at a pressure greater than atmospheric pressure, d. mixing said heating gas and cooling gas within said gas flow space after passage through said respective zones, and e. feeding said mixed heating and cooling gases through said heating zone.

2. A process as in claim 1 wherein about two-thirds of the gases discharged into said gas flow space is recirculated to said heating zone.

3. A self balancing dryer having wall means forming an enclosure enclosing at least one porous dryer column into which a moisture-ladened granular material is fed for drying therein:

a. said dryer column comprising a heating zone and a cooling zone, said cooling zone receiving said granular material from said heating zone, b. said wall means being spaced outwardly from said dryer column in at least one direction forming a gas flow space therebetween extending along said dryer column heating zone and cooling zone and opening to the atmosphere without flow through said dryer column, c. a heating gas supply means positioned to feed a heating gas through said column heating zone and into said gas flow space, d. a cooling gas supply means located to feed a cooling gas through said column cooling zone at a pressure greater than atmospheric pressure and into said gas flow space, e. said gas flow space having free communication therein permitting mixing of said heating gas received thereinto with said cooling gas received thereinto, and f. recycle means communicating between said gas flow space and said heating gas supply means and directing mixed heating and cooling gases to said heating gas supply means for feeding through said column heating zone.

4. Apparatus as in claim 3 wherein said heating zone and said cooling zone are both vertically elongated columnar zones that are bounded by first and second porous walls which substantially retain said material within said zones, but through which said heating and cooling gases pass upon entering and leaving the respective zones, the heating zone being located above the cooling zone, and further comprising feed means for supplying moist granular material to the top of the heating zone and discharge means for removal of the granular material from the bottom of the cooling zone.

5. Apparatus as in claim 4 and further comprising turning means in said heating zone whereby the downward flow of granular material therein is diverted from along one of said walls toward the other wall.

6. Apparatus as in claim 5 wherein said turning means are located about midway of the length of said zones.

7. Apparatus as in claim 4 wherein said cooling gas supply means comprises a first gas blower having an inlet leading from the atmosphere and an outlet leading to the first of said porous walls in the proximity of said cooling zone, and recycle means comprising an enclosure into which heating and cooling gases are discharged through the second of said porous walls, and said heating gas supply means comprises:

a. a second gas blower having an inlet leading from said recycle means, b. an outlet from the second gas blower leading to the first of said porous walls in the proximity of said heating zone, and c. means for supplying heat to gases introduced into said heating zone by said second blower.

8. Apparatus as in claim 7 wherein said first blower is located in said enclosure in the proximity of the lower portion of said zones, said enclosure having an inlet vent open to the atmosphere which is adjacent said inlet of the first blower.

9. Apparatus as in claim 8 wherein said second blower and the outlet thereof are located in said enclosure, and further comprising a partition between said first and second blowers.

10. Apparatus as in claim 7 wherein said means for supplying heat to said heating gas is a fuel burner which produces hot combustion gases that are mixed with gases supplied to said heating zone by means of said second blower.

11. Apparatus as in claim 7 and further comprising screening means whereby fine particles of the granular material which pass through said second porous wall along with the heating and cooling gases are removed therefrom prior to entry of the gases into the inlet of said second blower.

12. Apparatus as in claim 7 wherein said enclosure encloses said heated gas supply means and at least a portion of said first and second porous walls of the heating and cooling zones.

13. Apparatus as in claim 3 including screening means in said recycle means for removal of solids from the gases before feeding through said column heating zone.

14. A process as in claim 1 wherein said heating and cooling zones are both vertically elongated, interconnected columnar zones, the heating zone is located above the cooling zone, heating and cooling gases are passed transversally through the heating and cooling zones respectively, moist granular material is fed into the top of the heating zone, and wherein cooled, dried granular material is removed from the bottom of the cooling zone.

15. A process as in claim 14 in which said mixed gases are screened for removal of solids from the gases before being supplied to the heating zone.

16. A process as in claim 15 wherein the downward flow of granular material in said interconnected zones is diverted from one side to the other side thereof at about the longitudinal midpoint of the zones and wherein about one-third of the gases discharged from said zones into said gas flow space is vented into the atmosphere while about two-thirds thereof is recirculated to provide a heated mixture that is supplied to said heating zone as heating gas.

17. A process as in claim 15 wherein said heating gas is heated by mixture with hot combustion gases produced by burning a fluid fuel.

* * * * *